United States Patent [19]

Kaplan et al.

[11] 4,130,472

[45] Dec. 19, 1978

[54] PROCESS FOR MAKING COLOR TELEVISION SCREENS BY ELECTROPHORETIC DEPOSITION

[75] Inventors: Sam H. Kaplan, Chicago; Philomena C. Libman, Mt. Prospect; William E. Wainscott, Rockford, all of Ill.

[73] Assignee: Zenith Radio Corporation, Glenview, Ill.

[21] Appl. No.: 891,098

[22] Filed: Mar. 28, 1978

[51] Int. Cl.[2] ..... C25D 13/02; C25D 13/16

[52] U.S. Cl. ..... 204/181 N

[58] Field of Search ..... 204/181 N

[56] References Cited

U.S. PATENT DOCUMENTS 3,904,502 9/1975 Phillips ..... 204/181 N

*Primary Examiner*—Howard S. Williams

*Attorney, Agent, or Firm*—Ralph E. Clarke, Jr.

[57] ABSTRACT

This disclosure sets forth a process for electrophoretically depositing patterns of image-related compounds on the inner surface of the faceplate of shadow-mask-type television cathode ray picture tubes. The process comprises the depositing of a pattern of groups of periodically repeating electrically conductive stripes of predetermined graduated length from relatively long to relatively short. Both ends of stripes of similar length, starting with the relatively long stripes, are electrically excited with a charge of a first polarity by means of conductive contact strips during immersion in an electrolytic bath including an image-related compound having particles charged with a potential opposite in polarity to said first polarity for electrophoretic deposition of the particles on the stripes. Both ends of stripes of successively shorter lengths are than serially electrically excited in conjunction with a different bath including a different image-related compound for electrodeposition on the respective stripes. By electrically contacting both ends of the stripes, the effect of a single discontinuity in the electrical conductivity of any of the stripes is nullified, as any stripe having such a discontinuity is electrophoretically coated along its entire length.

3 Claims, 5 Drawing Figures

PROCESS FOR MAKING COLOR TELEVISION SCREENS BY ELECTROPHORETIC DEPOSITION

BACKGROUND AND PRIOR ART STATEMENT

This invention relates generally to methods of making striped screens for television picture tubes, and more particularly, to an improved process for forming such screens by electrophoretic deposition.

The standard process of depositing patterns of color phosphors on the inner surface of a color picture tube faceplate is well known in the art. Essentially, the process consists of a series of several steps comprising the deposition of three different color phosphor compounds, one for each primary color. A shadow mask which is, in effect, a perforated "optical stencil," is used in conjunction with a light source to expose and screen three discrete photo-resist patterns on the faceplate. The shadow mask is "mated" to each faceplate; that is, the same mask is used in the production of a specific tube throughout the production process, and is finally installed permanently in that tube. Four engagements and four disengagements of the mask, and six exposures, are required in the standard process. Although this process is widely used, it has many disadvantages. The most significant of these lies in the many steps required in the production process including the numerous removals and installations of the mask which must remain in precise registery through the process. Another disadvantage lies in the multiple exposures required. In addition, there is a considerable waste of chemicals including the costly phosphor compounds. The reject rate in manufacture may be substantial, and is usually attributable to a breakdown at some point in the relatively complex production process.

In certain faceplate screening processes, a "master" may be used for exposing the photo-resist patterns in lieu of the mated shadow mask heretofore described. Such a master is not permanently associated with a single specific faceplate, but comprises an interchangeable component that can be used to screen production quantities of faceplates. A master, however, is used mainly in tube types that do not utilize a shadow mask, such as the beam-index tube. For shadow-mask type-tubes, interchangeable mask systems have not proved feasible in production.

An alternate means for deposition of screening compounds is that of electrophoretic deposition, also called "cataphoretic deposition." In this process, screening compounds which may include phosphor particles suspended in an electrically low conductive fluid, or "particle suspensions," are caused to migrate through an electric field in the fluid to a surface having an opposite charge, and on which the desired pattern is to be deposited. There are many advantages to the electrophoretic deposition process that makes it attractive; however, experience has revealed inherent problems that has made the process unacceptable to data as a viable alternative to the aforedescribed standard process.

U.S. Pat. No. 3,681,223 to Gupton discloses means whereby color phosphors are electrophoretically deposited on a cathode ray tube faceplate to provide a dot screen. A plurality of conductive dot patterns are deposited on the faceplate, one pattern for each color to be deposited. Each pattern includes lands of material on which the dots are to be deposited with conductive paths interconnecting the lands. The conductive patterns are deposited with a single masking operation using an interchangeable master. The different color phosphors are then successively deposited on dot patterns by electrophoresis, one color phosphor being deposited on each discrete conductive pattern. The conductive paths are said to be one-mil wide. The conductive paths for the blue and green phosphor patterns are shown as being relatively short (perhaps only as long as the heighth dimension of the tube), and are shown as being interdigitated. The conductive path for the red phosphor, however, which proceeds as a continuous one-mil strip between the interdigitations of the blue and green conductive paths is relatively long; e.g., about 900 feet long in a 25-inch picture tube. The problem of laying down a conductive path of such length with an inter-dot width of only one mil without an electrically interrupting gap is considered to be insurmountable. Even if there were no gaps, the end-to-end variation in electrical potential on the one mil strip due to the IR drop along the strip would result in uneven phosphor deposit. The process as disclosed by Gupton requires a master exposure system; as noted, interchangeable mask systems have not been commercially proven.

In Canadian Pat. No. 964,713, Standaart discloses a process for the electrophoretic deposition of color phosphors in a dot-screen pattern. A separate dot pattern with an inter-connecting conductive path is provided for each color. An electrical potential is applied to an end of each path by means of a clamping device for the deposition of each color. The means for applying the potential are not disclosed. This system is based on the use of an interchangeable mask.

OBJECTS OF THE INVENTION

It is a general object of this invention to provide an improved process for the manufacture of striped-screen television picture tubes.

It is another object of the invention to provide major cost reductions in the manufacture of such picture tubes.

It is a more specific object to provide a feasible and practical electrophoretic deposition process for the manufacture of stripe-screen picture tubes of the type utilizing a non-interchangeable shadow mask.

BRIEF DESCRIPTION OF THE DRAWINGS

The features of the present invention which are believed to be novel are set forth with particularity in the appended claims. The invention together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

Figure 1:
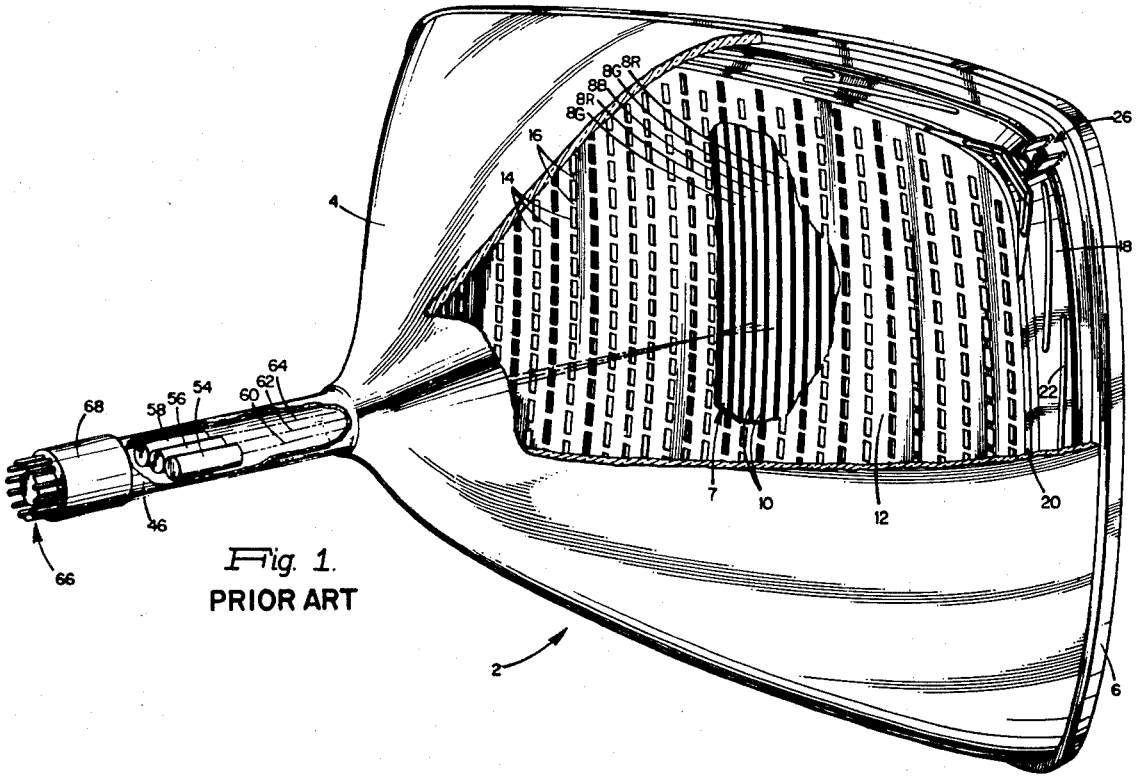
Fig. 1. PRIOR ART
FIG. 1 is a view in perspective of a prior art television picture tube having a striped screen.

This invention may be employed in the manufacture of the prior art color television picture tube shown by FIG. 1. The tube has a glass funnel 4 sealed to a faceplate 6. Three electron guns 54, 56 and 58 are contained in the neck 46 of the tube 2. The three guns 54, 56 and 58, shown as being of in-line configuration, are electrically connected to pins 66 through base 68, and are arranged to emit respective electron beam components 60, 62 and 64.

The electron beam components 60, 62 and 64 are accelerated in a known manner to pass through a deflection field produced by scanning signals applied to a yoke member (not shown) which is positioned about the neck of 46 of the tube 2 adjacent to the funnel portion 4. This deflection field changes the course of the electron beam components in accordance which the instantaneous sweep signals applied to the yoke member. After being deflected, the electron beam components 60, 62 and 64 are directed through apertures 14 in a color selection electrode, or "shadow mask" 12, to impinge on the scanning side of a multi-color image screen composed of red-light-emissive phosphors 8R, green-light-emissive phosphors 8G, blue-light-emissive phosphors 8B, and light-absorbing areas 10. Red-light-emissive phosphors 8R, green-light-emissive phosphors 8G, and blue-light-emissive phosphors 8B are shown as being disposed on the inside surface of faceplate 6 in a lineated pattern of discrete, individually continuously vertical lines or "stripes" centered on the major axis of rectangular faceplate 6.

Shadow mask 12 includes a plurality of apertures 14 comprising "slots" in the form of narrow rectangular openings. Adjacent phosphor elements form a plurality of "triads", each comprising a group of three phosphors which individually emit red, green or blue light upon excitation by an associated electron beam component. The triads correspond in position to the portion of a corresponding aperture in mask 12 in such a manner considering the positions of the electron guns 54, 56, 58, that the electron beam components 60, 62 and 64 selectively impinge upon corresponding phosphor elements.

In the production of color picture tubes of the type described, shadow mask 12 is permanently paired or "mated" with faceplate 6 of the tube 2; the same mask is used exclusively during the screening process and is permanently installed before that tube is sealed. A plurality of disengageable mask mounting means 26 attached to skirt 18 of mask 12 are spaced about the periphery of the mask 12 to provide for detachable engagement of mask 12 to faceplate 6 in precise registration thereto. Four engagements and four disengagements of the mask with respect to the faceplate are required in the standard stripe-screen faceplate screening process. The same mask is finally installed permanently in the picture tube prior to the sealing of the tube.

Figure 2:
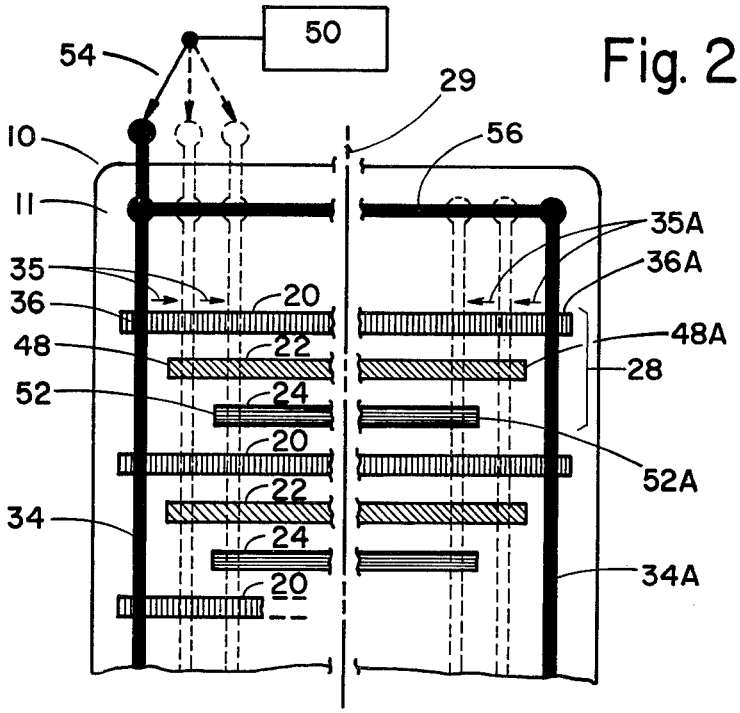
FIG. 2 indicates in highly schematic form major steps in the electrophoretic deposition process according to the invention.

FIG. 2 shows schematically major steps in the process according to the invention for electrophoretically depositing patterns of image-related compounds on the inner surface 11 of a faceplate 10. A pattern of groups of periodically repeating electrically conductive stripes are deposited on the inner surface 11. The stripes in each group are of a predetermined graduated length from relatively long to relatively short. The stripes are shown in this example as being grouped in triads; a typical triad 28 is indicated by the associated bracket. Triad 28 (and all other such triads) comprise, in this example, a relatively long stripe 20, a relatively short stripe 24 and a stripe 22 having a length intermediate thereto. The stripes are shown as being centered on the major axis 29 of the rectangular faceplate 10.

The lines superimposed on conductive stripes 20, 22 and 24 as illustrated are standard graphical symbols for red, green and blue, respectively, and indicate the color of the light emitted by the phosphors electrophoretically deposited on the stripes according to the invention, as will be shown. The invention is not limited to this allotment of color phosphors; for example the red-light-emitting phosphor indicated as being deposited on relatively long stripes 20 could as well be deposited on relatively short stripe 24 or stripe 22 of intermediate length thereto. In a 25-inch picture tube, 600 triads are typically required, for a total of 1800 stripes, each coated with a selected one of the color phosphors.

The patterns of conductive stripes serve as the foundation for the deposition of image-related compounds, such as a phosphor compound, by the electrophoretic deposition process. Electrical excitation, such as by physical contact by means of a conductive contact strip during the electrophoretic deposition process, is accomplished at both ends of each stripe, according to the invention. The problems in making such contact would, at first inspection, seem insurmountable due to the number of such contacts required. As noted, in a 25-inch tube, there are typically 600 such triads each comprising a red, green and a blue stripe, or 1800 stripes in all. If contact is to be made at both ends of each stripe, a total of 3600 contacts must be made in a complete process. The problem is exacerbated by the fact that the stripes are closely spaced, and the contacting means must selectively contact both ends of only one stripe in each triad at one time.

The selective contacting could conceivably be done by means comprising 1800 pairs of conductive "fingers" with each finger of each pair contacting an end of a shared line. A suitable electrical switch could be used to sequentially energize the respective stripes through the fingers. Or, the contact means could comprise a structure consisting of 600 pairs of such conductive fingers, and the entire structure could be physically moved in a direction of the major axis 29 of the faceplate to electrically register each finger on the desired stripe.

Such contacting means, while theoretically possible, are impractical in view of the fact that the width of each stripe is only 8.5 mils, and because of the variation in tube-to-tube screen parameters. A contacting means comprising so many contacting fingers 8.5 mils in width would be difficult to fabricate and difficult to use, especially in the manufacturing environment. The solution according to the invention provides a practical means of insuring positive electrical contact with both ends of selected stripes, one readily adaptable to manufacturing.

Figure 3:
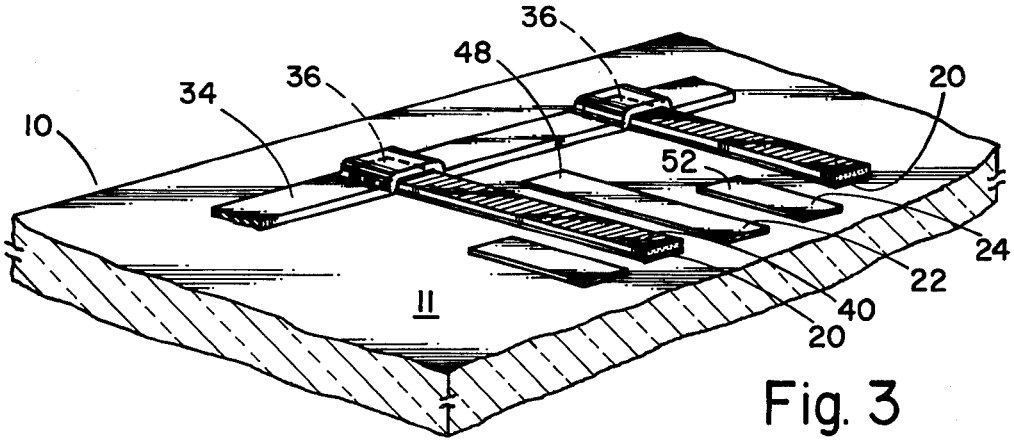
FIG. 3 is a view in perspective of a fragment of the faceplate of a color cathode ray tube showing the structure during a step of the process according to the invention.

With additional reference to FIG. 3, the process according to the invention for electrophoretically depositing an image-related compound, in this case a phosphor, on the inner surface 11 of faceplate 10 according to the invention is now described in greater detail.

An electrically conductive coating is deposited on the inner surface 11 of the faceplate 10. The conductive coating may comprise a film of tin oxide, or, aluminum (used as an example in this description) evaporated on the inner surface. The thickness of the conductive coating is preferably in the range of 0.01 to 1.0 micron.

A negative-working photo-polymer layer is next deposited on the conductive coating. The photo-polymer contains a sensitizing agent such as ammonium dichromate. A shadow mask is attached to the faceplate by disengagable mask mounting means (typified by mounting means 26 of FIG. 1). The shadow mask is "mated" to faceplate, and is located in precise registration thereto by the mask-mounting means.

The surface of the faceplate, coated as described heretofore, is then selectively exposed to a source of light actinic to the photo-polymer layer to establish a latent periodically repeating pattern of conductive stripes in the photo-polymer layer. Also as heretofore described, the conductive stripes are grouped in triads represented in FIG. 2, for example, by the group 28 comprising stripes 20, 22 and 24.

Following the exposures, the shadow mask is disengaged from the faceplate. It will be observed that only one engagement of the shadow mask is required in lieu of four in the standard process, and that only three exposures are required instead of the usual six.

The exposed latent pattern of stripes is then fixed, and exposed areas of the photo-polymer on the surface are removed to leave the periodically repeating pattern of conductive stripes. The latent pattern of stripes may be "developed" by means of a stream of water. If a water-soluble photo-polymer is used, it may have to be baked. Then an etchant for the aluminum is used to etch away any aluminum not protected by the photo-polymer. The photo-polymer may now be removed, as with hydrogen peroxide, leaving the conductive aluminum stripes separated by bare glass. With reference again to FIG. 2, what now remains on inner surface 11 of faceplate 10 after the aforedescribed processes is a pattern of triads of conductive stripes, with each triad comprising a relatively long stripe 20, a stripe 22 of intermediate length, and a relatively short stripe 24. There may be 600 such triads deposited on an inner surface of the faceplate of a 25-inch color picture tube, for a total of 1800 conductive stripes.

With reference also to FIG. 3, an electrical potential of a first polarity from a suitable power source is applied by means of contact stripes 34 and 34A simultaneously to the projecting ends of all the relatively long stripes, as typified by the ends 36 and 36A of relatively long stripe 20. The electrically exciting potential of a first polarity may comprise for example, a negative potential of about 100 volts, or, the polarity may be positive and comprise a different potential dependent on the particular requirements of the electrophoretic deposition process. Contact strips 34 and 34A, are shown as being conformable in their contact with the projecting ends 36 and 36A of the long stripe 20 of triad 28, and may comprise an elastic material such as an electrically conductive elastomer. Alternately, the conductive strip could as well comprise a strip of stainless steel, for example, having adequate conformability. During the electrical excitation of contact strips 34 and 34A, the faceplate is immersed in an electrolytic bath including an image-related compound consisting of a fluid suspension of particles such as for example, phosphor particles. The particles in the bath are charged with a potential of a second polarity opposite to the aforedescribed first polarity. The electrical excitation of the particles may be provided by an electrically charged "counter-electrode" submerged in the bath. The bath may include a phosphor capable of emitting a selected first color, shown in FIG. 3 as being red and as being deposited on stripes 20. As a result of electrophoretic action, the phosphor particles contained in the bath are deposited on all of relatively long stripes 20 contacted by contact strips 34 and 34A. Following the complete deposition of red phosphor 40, the bath is washed from the inner surface 11 of faceplate 10, and surface 11 is dried according to well-known practice.

The aforedescribed steps with regard to the electrophoretic deposition of the phosphor compound on the relatively long stripes is twice repeated for phosphors of other colors, as follows. Second and third image-related compounds, also described as being phosphors for exemplary purposes, are electrophoretically deposited on respectively associated second and third patterns of conductive stripes comprising stripes 22 of intermediate length and relatively short stripes 24. Both ends of stripes of successively shorter lengths such as stripes 22 of intermediate length, and relatively short stripes 24 are serially electrically excited by contact stripes 34 and 34A. Each such exciting is accompanied by an immersion in a different bath each including (in this example) the second and third compounds respectively for electrophoretic deposition on the respective conductive stripes. The complete process is described in additional detail in following paragraphs.

With regard to the means for selectively contacting the ends of the respective stripes, contact strip 34 and 34A could be physically relocated for each such contacting, as indicated by arrows 35 and 35A in FIG. 2. The electrical connection of strip contact 34 to a power source 50 (see FIG. 2) is indicated schematically by conductor 54. The interconnection of strip contacts 34 and 34A is indicated, again schematically, by electrical bus 56.

However, since the process according to the invention provides for a series of different electrolytic baths, it may be expedient to provide a series of separate bath containers each provided with suitable strip contacts for the purpose of contacting only the projecting ends of the conductive stripes to be electrodeposited in that particular bath.

Figure 4:
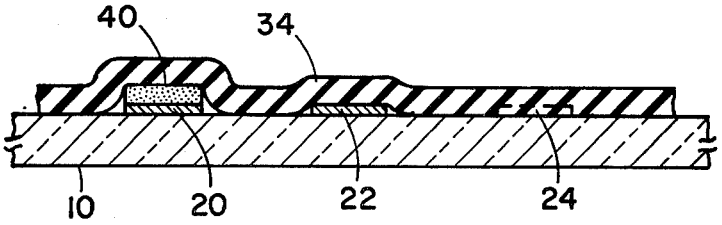
FIG. 4 is a cross-sectional view of the faceplate of FIG. 3, showing another view of a step in the process.

FIG. 4 shows a view in cross-section of electrical contact being made by contact strip 34 (indicated as being of a flexible, rubber-like composition) with stripe 22 of intermediate length deposited on the inner surface 11 of faceplate 10. The end of relatively short stripe 24 is shown by a broken line, indicating that physical (and electrical) contact is not being made with the end of relatively short stripe 24. It will be observed also that contact strip 34 is held away from contact with relatively long stripe 20 by phosphor deposit 40, which was deposited in a previous step in the process. (Note that the relative thickness of conductive stripe 20 and phosphor deposit 40 as shown by the drawing are not to scale. The conductive stripe may be less than one micron in thickness, for example, and the phosphor deposit may be in the range of 5–15 microns in thickness.) Phosphor deposit 40, after its deposition, has become sufficiently insulative due to its thickness and composition to isolate relatively long stripe 20 from electrical contact with contact strip 34. This insulative effect precludes any electrophoretic deposition of the phosphor to be deposited on stripe 22 on relatively long stripe 20. In brief, if a green phosphor were being deposited on stripe 22, there would be little or no electrophoretic deposition of the green phosphor (cross contamination) on the surface of phosphor deposit 40, shown as being a red phosphor. Similarly, when contact strip 34 is relocated to contact the end of relatively short stripe 24 to provide for a deposit of blue phosphor thereon, for example, stripe 22 of intermediate length will have received a sufficiently thick deposit of phosphor to become insulative, and hence be electrically isolated from contact strip 34 so that little or no further deposit on stripe 22 (or on stripe 20) will take place. Thus the insulative nature of the electrophoretic deposit makes possible the serial deposition of the phosphors according to the invention.

Following the electrical exciting of contact strip 34 with a charge of a first polarity to both ends of stripes 22 of intermediate length, surface 11 of faceplate 10 is immersed in a bath having particles charged with a potential of a second polarity opposite to the first polarity. The bath may include phosphor particles of a second color, indicated as being green in this example. As a result, the phosphor is electrophoretically deposited on conductive stripes 22. The bath fluid is washed from the surface 11 of faceplate 10 and the surface is dried.

Relatively short stripes 24 may now be coated with a phosphor deposit, indicated graphically as being blue-light-emitting phosphor. As in the process described heretofore, conductive strips 34 and 34A are caused to make contact with both the projecting ends 52 and 52A, or relatively short stripes 24. Faceplate 10 is then immersed in a bath having particles charged with a potential of a second polarity opposite in polarity to that of the contact strips. The bath includes phosphor particles which are now electrophoretically deposited on relatively short stripes 24. Surface 11 of faceplate 10 is then washed and dried.

Following the process as described, the pattern of underlying conductive stripes may be chemically stripped away to prevent masking of the light emitted by the phosphors thereon deposited. Experiments have shown that the adherence of the phosphor deposits to the glass of the faceplate is not affected by the removal of the interposed conductive stripes.

When screening a black-surround negative guard-band tube, various means well-known in the art may be used to provide a layment of light-absorptive material between the phosphor stripes deposited according to the teachings of this invention.

Following the electrophoretic deposition process according to the invention, the faceplate, with its array of striped patterns, may be aluminized according to any of a number of well-known processes.

The process according to the foregoing description provides for the electrophoretic deposition of compounds on groups of three conductive stripes of predetermined graduated lengths. The process is nowise limited to groups of three stripes; the number of stripes per group, for example, may range from two to any practical number. Further, the allocation of phosphor compounds need not be as described; e.g., the red-light-emitting phosphor could as well be deposited on conductive stripes of intermediate length or on the relatively short stripes. Similarly, the deposition of phosphors emitting light of other colors may be similarly allocated according to the requirements of a particular tube specification.

Compounds other than phosphors may also be deposited according to the invention. For example, a compound comprising the "index" stripe of a beam-index tube may be applied to the inner surface of a tube faceplate according to the invention. This compound may comprise an emitter capable of providing invisible radiation, such as ultraviolet radiation. The index stripe could be deposited to lie contiguous to a triad of color phosphors, for example. For electrophoretic deposition according to the teachings of the invention, the index stripe could be the longest in the series of stripes of predetermined lengths graduated from the longest to the relatively short. Again, it is to be noted that this order is not mandatory; the index stripe could as well comprise the relatively short stripe, or a stripe of intermediate length.

With regard to general values and limits of the process according to the invention, the thickness of the phosphor deposited electrophoretically is preferably in the range of 5–15 microns. During the deposition, the phosphor builds up rapidly at first; then the build-up becomes progressively slower with increasing thickness as the electrical resistance of the phosphor is proportional to its thickness. Experiments have shown that a time duration in the range of one and one-half to two minutes is required to build up an adequate thickness of phosphor. During the last part of the deposition process, there is almost no depositing of phosphor due to the increase of resistance with thickness. This increase in resistance and resultant decrease in conductivity makes possible the selective electrical excitation of lines of predetermined graduated lengths according to the invention.

The density of the deposited phosphor is typically about 4.5 milligrams per square centimeter, using for depositing a voltage in the range of 100 to 200 volts and a current preferably in the range of one-half to two milliamperes per square centimeter. It is to be noted that these and other values cited in this disclosure are not limiting but are supplied for exemplary purposes only.

Figure 5:
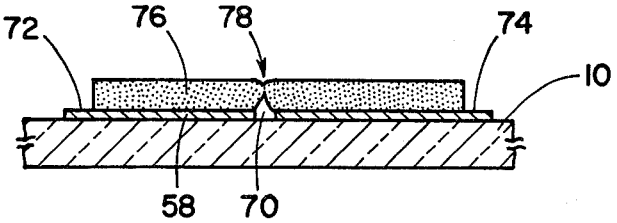
FIG. 5 is a cross-sectional view of a faceplate indicating schematically a benefit achieved by the process according to the teachings of the invention.

A major benefit provided by the invention is that by electrically exciting both ends of the conductive stripes, the effect of a single discontinuity in electrical conductivity of any of the stripes is nullified. Any stripe having such a discontinuity is electrophoretically coated along its entire length with the desired compound. This benefit is shown schematically by FIG. 5 wherein a conductive stripe 58 having a discontinuity 70 is shown as being deposited on the faceplate 10. By electrically exciting both ends of conductive stripe 58; that is, ends 72 and 74 according to the invention, the effect of discontinuity 70 in the electrical conductivity of conductive stripe 58 is nullified, as phosphor 76 is deposited along the entire length of conductive stripe 58. It has been shown by experiment that unless discontinuity 70 is exceptionally wide, any visual effect of discontinuity 70 will be unobservable to the viewer. This unobservability is enhanced by the fact that phosphor 76 has been shown to substantially bridge over a discontinuity 70, as indicated by bridging area 78.

The value of contacting both ends of the conductive stripes according to the claimed invention in reducing the number of cathode ray tube rejects during manufacture, is shown by a simple exercise in probabilities. Let us assume a probability that a discontinuity will appear in one line in every twenty-fifth tube (that is, one discontinuity for each 45,000 lines), resulting in an unacceptably high reject rate of 4%. The odds of two discontinuities occurring in the same line is equal to one in 45,000 × 45,000 times, or one in 2.025 billion. Assuming that the uncoated line segment between any two discontinuities would result in a reject tube, this translates to a reject rate of only one in 1.8 million tubes. Thus, by this invention (even while admitting the above figures to be but rough estimates), it can be seen that a screening process has been converted from one with an intolerably high reject rate to one with a tolerably insignificant reject rate attributable to line discontinuities. (It should be understood of course that such line discontinuities are but one of many possible causes of tube rejects.)

Other benefits of the invention include a substantial savings in the quantities of image-related compounds otherwise required—phosphors, for example. Only the amount of compound electrophoretically deposited would be withdrawn from an electrolytic bath. Any of the compound lost during a subsequent washing process could be retrieved from the washing fluid.

Another major benefit lies in the fact that only one mask engagement (not including the final installation) and one disengagement are required in the production process according to the invention, rather than the four engagements and four disengagements required in the standard process. This reduction in the number of such engagements and disengagements could make possible a structural simplification of the mounting means and a consequent cost reduction. Also, the incidence of mask rejects due to denting relates directly to the number of times a mask must be inserted and removed.

Another benefit of the invention would be realized in the savings in exposure time. Not only are fewer exposures needed—three as against the six normally required for the black-surround tube—but the exposures eliminated, namely the phosphor exposures, are normally the longest in duration. It is conservatively estimated that savings of about 75 percent in exposure time would be realized.

The reduction of process steps that can be realized by the invention would also make possible a considerable reduction in factory floor space otherwise required for the present process.

Other changes may be made in the above-described process without departing from the true spirit and scope of the invention herein involved, and it is intended that the subject matter in the foregoing depiction shall be interpreted as illustrative and not in a limiting sense.

We claim:

1. For use in the production of a striped-screen television image display faceplate, a process for electrophoretically depositing patterns of image-related compounds on said faceplate, the process comprising:

depositing a pattern of groups of periodically repeating electrically conductive stripes on said faceplate, said stripes in said groups being of a predetermined graduated length from relatively long to relatively short;

electrically exciting by means of conductive contact strips with a charge of a first polarity both ends of said relatively long stripes during immersion of said faceplate in an electrolytic bath including an image-related compound having particles charged with a potential of a second polarity opposite to said polarity for electrophoretic deposition of said particles on said stripes;

serially electrically exciting both ends of stripes of successively shorter lengths, accompanying each such exciting with a different bath including a different image-related compound for electrophoretic deposition on the respective stripes;

whereby, by electrically contacting both ends of said conductive stripes, the effect of a single discontinuity in electrical conductivity of any of said stripes is nullified as any stripe having such a discontinuity is electrophoretically coated along its entire length with said compound.

2. For use in the production of a striped-screen shadow-mask-type color television cathode ray tube, a process for electrophoretically depositing patterns of image-related compounds on the inner surface of the faceplate of said tube, the process comprising:

depositing on said inner surface of said faceplate periodically repeating patterns of electrically conductive stripes, said stripes being grouped in triads, with each triad comprising a relatively long stripe, a relatively short stripe, and a stripe having a length intermediate thereto;

electrically exciting with a charge of a first polarity both ends of all of said relatively long stripes, using for excitation at least one electrically conductive contact strip;

immersing said faceplate in an electrolytic bath including an image-related compound having particles charged with a potential of a second polarity opposite to said first polarity, for electrophoretic deposition of said particles on the respective stripes;

twice repeating the aforedescribed exciting and immersing steps to electrophoretically deposit second and third image-related compounds on respectively associated second and third patterns of conductive stripes, including serially electrically exciting with a contact strip both ends of said stripes of intermediate length and said relatively short stripes, accompanying each such contacting by an immersion in a bath including said second and third compounds respectively for electrophoretic deposition on the respective conductive stripes;

whereby, by electrically exciting both ends of said conductive stripes, the effect of a single discontinuity in electrical conductivity of any of said stripes is nullified as any stripe having such a discontinuity is electrophoretically coated along its entire length with said compound.

3. For use in the production of a striped-screen shadow-mask-type color television cathode ray tube, a process for electrophoretically depositing a pattern of phosphor compounds on the inner surface of the faceplate of said tube, using to establish said pattern a slot shadow mask mated with said faceplate in precise registration thereto by disengageable mask mounting means, the process comprising:

depositing on said inner surface an electrically conductive coating;

depositing on said coating a negative-working photopolymer;

engaging said shadow mask to said faceplate by said mask-mounting means;

selectively exposing said surface to a source of light actinic to said photo-polymer through said shadow mask to establish a latent, periodically repeating pattern of conductive stripes in said photopolymer; said stripes being grouped in triads, with each triad comprising a relatively long stripe, a relatively short stripe, and a stripe having a length intermediate thereto;

disengaging said shadow mask from said faceplate;

fixing the exposed latent pattern of stripes and removing exposed areas of said surface to leave said pattern of conductive stripes on said inner surface of said faceplate;

electrically exciting with a charge of a first polarity both ends of all of said relatively long stripes, using for excitation at least one electrically conductive conformable contact strip; immersing said faceplate in an electrolytic bath including an image-related compound having particles charged with a potential of a second polarity opposite to said first polarity for electrophoretic deposition of said particles on the respective stripes;

twice repeating the aforedescribed exciting and immersing steps to electrophoretically deposit second and third image-related compounds on respectively associated second and third patterns of conductive stripes, including serially electrically exciting with a contact stripe both ends of said stripes of intermediate length and said relatively short stripes, accompanying each such contacting by an immersion in a bath including said second and third compounds respectively for electrophoretic deposition on the respective conductive stripes;

stripping away chemically said pattern of conductive stripes;

whereby, by electrically exciting both ends of said conductive stripes, the effect of a single discontinuity in electrical conductivity of any of such stripes is nullified as any stripe having such a discontinuity is electrophoretically coated along its entire length with said compound.

* * * * *